US005523778A

United States Patent [19]

Fickling

[11] Patent Number: 5,523,778

[45] Date of Patent: Jun. 4, 1996

[54] SEGMENTED CHARGE TUNNEL FOR DROP CHARGING IN A PRINTHEAD

[75] Inventor: Andrew E. Fickling, Mt. Prospect, Ill.

[73] Assignee: Videojet Systems International, Inc., Wooddale, Ill.

[21] Appl. No.: 163,166

[22] Filed: Dec. 7, 1993

[51] Int. Cl.[6] ..... B41J 2/115

[52] U.S. Cl. ..... 347/76; 347/80; 347/81

[58] Field of Search ..... 347/73, 74, 76, 347/78, 80, 81

[56] References Cited

U.S. PATENT DOCUMENTS

| | | | |
|---|---|---|---|
| 3,769,625 | 10/1973 | Gunn | 347/76 |
| 3,866,237 | 2/1975 | Meier . | |
| 3,975,741 | 8/1976 | Solyst | 347/76 |
| 4,345,522 | 8/1982 | Miyamoto et al. . | |
| 4,417,256 | 11/1983 | Fillmore et al. . | |
| 4,550,321 | 10/1985 | Sato et al. | 347/81 |
| 4,560,991 | 12/1985 | Schutrum . | |
| 4,568,946 | 2/1986 | Weinberg | 347/76 |
| 4,631,549 | 12/1986 | Braun et al. . | |
| 4,633,268 | 12/1986 | Miroku . | |
| 4,638,325 | 1/1987 | Schneider et al. . | |
| 4,638,326 | 1/1987 | Yamada et al. . | |

FOREIGN PATENT DOCUMENTS

| | | |
|---|---|---|
| 0132972 | 2/1985 | European Pat. Off. . |

*Primary Examiner*—John E. Barlow, Jr.
*Attorney, Agent, or Firm*—Rockey, Rifkin and Ryther

[57] ABSTRACT

A segmented charge tunnel for ink jet printing having a plurality of individual segments is utilized to sequentially apply charges to a droplet stream. Precise location of the stream break-off point within the tunnel is accomplished by identifying which one of the segments of the charge tunnel is associated with the detection of a maximum charge by a downstream sensor. Precise determinations of the distance between the break-off point and the detection downstream permits accurate droplet flight time measurement to allow ink composition and spacing to be controlled.

16 Claims, 5 Drawing Sheets

SEGMENTED CHARGE TUNNEL FOR DROP CHARGING IN A PRINTHEAD

BACKGROUND AND SUMMARY OF THE INVENTION

The present invention relates generally to ink jet printing systems and similar drop marking systems in which a supply of electrically conductive ink is provided to a nozzle. Energy is applied to drive the nozzle and the ink is forced through the orifice of the nozzle which causes a stream of ink to separate into droplets at a break-off point. The drops are subsequently charged and deflected onto a substrate to be marked. Charging of the stream of droplets is generally accomplished in this art by directing the flight path of the stream either through or in the proximity of a charging electrode or ring.

Setting the location of the break-off point of the ink stream into droplets and the related task of determining the minimum break-off length have always been a problem in the art of ink jet printing. In order to ensure proper operating conditions for consistent printing quality, the location of the break-off point must be well inside of the charging ring. Preferably, the break-off is set near the minimum distance from the nozzle, a point referred to in the art as the foldback point. Typically a human operator must make manual adjustments while visually inspecting the location of the break-off point. Alternatively a single electrode in the vicinity of the stream separation point can be used to give an approximate position of the break-off point. Neither method provided sufficient control of printing quality.

What is desired is a system which more accurately can determine both the minimum break-off point (foldback) and the present location of the break-off point so that a precise measurement of the time of flight from droplet separation to the detection of the droplets at a downstream detector can be made. Utilization of a charging electrode which has many segments, each capable of being selectively charged via a switching controller, satisfies this desire. The segments are disposed along the direction of the flight path of the stream which allows the break-off point to be measured to within the length of one segment. In turn, this permits accurate determinations of the velocity of the droplets because the time of flight and distance are known. It also permits detection of the foldback point.

Accordingly, it is an object of the present invention to provide an ink jet printing system which utilizes a segmented charge tunnel which allows improved detection of the drop formation point and the foldback point.

It is a further object of the invention to provide a segmented charge tunnel which makes it possible to accurately determine the location of the break-off point so that a satisfactory determination of droplet time of flight can be made. Accurate time of flight measurements allow the droplet stream to be more precisely controlled which allows constant drop deflection and better printing quality to be maintained.

DETAILED DESCRIPTION OF A PREFERRED EMBODIMENT

Figure 1:
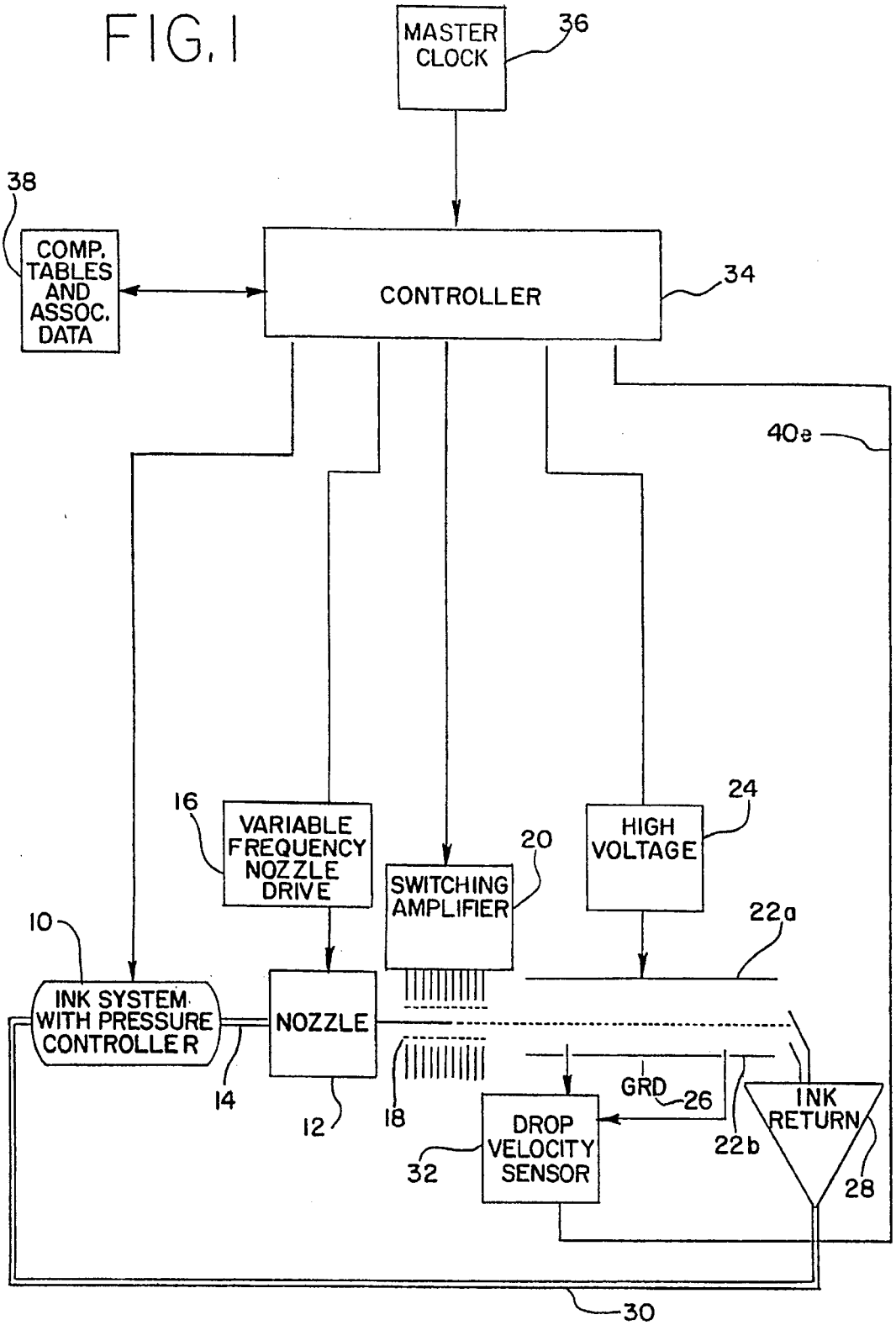
FIG. 1 is a schematic drawing of an ink jet printing system which incorporates a segmented charge tunnel according to the invention.

Referring to FIG. 1, a schematic drawing of an ink jet printing system which incorporates the use of a segmented charge tunnel is shown. The system utilizes electrically conductive ink, a supply of which is maintained in ink system 10 operated by a pressure controller. The ink is supplied from the ink system 10 and supplied to nozzle 12 via conduit 14 in a conventional manner.

A nozzle drive voltage is applied by driver 16 to nozzle 12 which causes the ink supplied to the nozzle 12 to break into a series of discrete drops. It is recognized that there are many methods of causing the ink stream to separate into drops such as the application of acoustic energy or the utilization of a voltage driven piezoelectric crystal. The drops are selectively charged by passing through a segmented charge tunnel 18, which has a plurality of segments 42*a–e* (FIG. 2), each connected to a switching amplifier 20 by connections 44 as more clearly shown in FIG. 2. Fabrication of the segmented charge tunnel 18 can be accomplished by various techniques such as hybrid and photo-lithographic technologies or by utilizing a specially designed flex circuit. By way of example, a flex-circuit (flexible runs of copper encased in mylar layers) may be designed to contain a number of copper runs equal to the number of segments desired. These runs are separated and enclosed in Mylar. The width of each copper run equals the desired width of the segments in the tunnel. The distance between copper runs equals the desired distance between segments. At one end of the flex-circuit are connectors to connect the copper runs to the charge amp switching logic. The flex-circuit charge tunnel, thus formed, is held in position by a chassis or similar supporting structure.

After passing through segmented charge tunnel 18, those drops which are electrically charged are deflected by high voltage deflection plates 22*a* and 22*b* onto a substrate to be marked (not shown). The plates 22*a* and 22*b* typically are connected to a high voltage source 24 and to ground 26. The drops which are not electrically charged are returned to the ink system 10 via conduit 30 after being collected by ink return 28. A drop velocity sensor 32 is cooperatively arranged with deflection plates 22*a* and 22*b* such that charged drops can be detected at a known location downstream from the segmented charge tunnel 18.

As shown in FIG. 1, a controller 34 is connected to ink system 10, driver 16, switching amplifier 20, high voltage source 24, drop velocity sensor 32, master clock 36 and a memory containing data files 38. The controller 32 may be a solid state logic system or, preferably, a programmable computer which is capable of executing the steps as listed in the flow diagrams of FIGS. 4 and 5.

The utilization of the segmented charge tunnel 18 in an ink jet printing system makes it possible to more precisely detect the time of flight of ink jet droplets from the break-off point of the ink stream into droplets. This provides for accurate measurement of droplet velocity which enables better management of the factors affecting drop formation, projection and deflection. These include ink viscosity, composition, temperature and pressure among others. Further, maintaining a precise droplet break-off distance, by controlling various factors such as the magnitude of the nozzle drive or ink pressure improves upon the properties of the charged drop.

Figure 2:
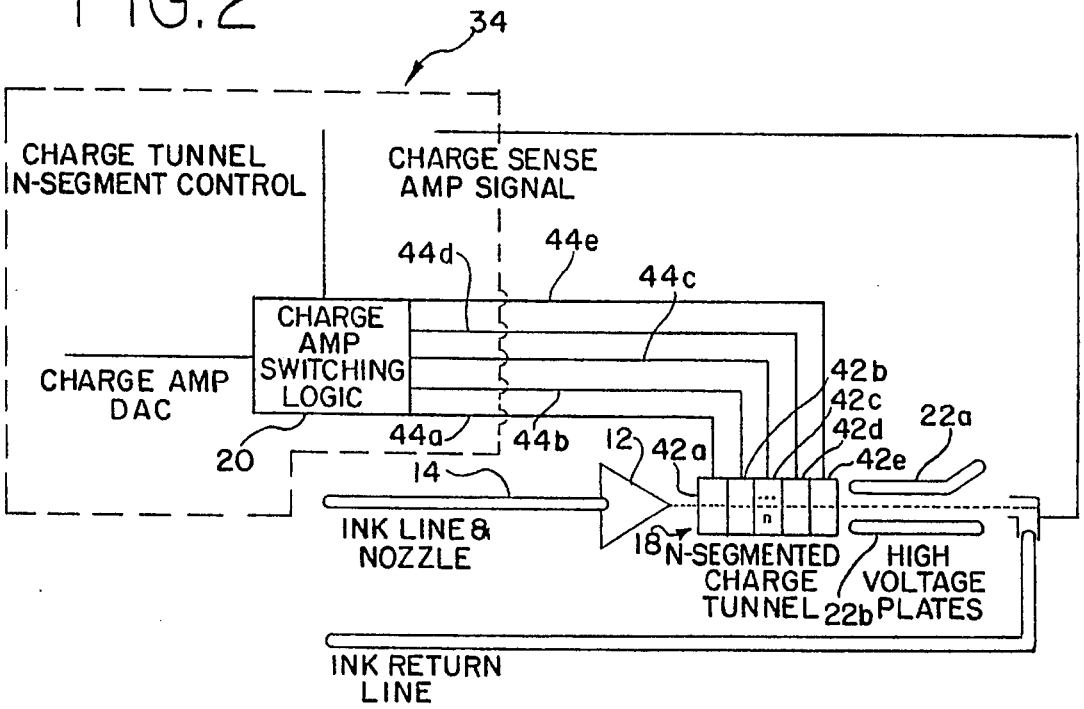
FIG. 2 is a schematic drawing of an ink jet printing system useful in explaining use of the segmented charge tunnel.

Referring to FIG. 2, the segmented charge tunnel 18 has a plurality of segments (5 in the illustrated example) 42*a*–42*e* which are individually connected to switching amplifier 20 via conductors 44*a–e*. The tunnel 18 is placed in the path of the jet stream such that the stream separation or break-off point preferably lies within its length at both high and low nozzle drive values. Each of the individual segments 42*a*–42*e* of tunnel 18 is capable of functioning as a charging electrode according to the signals received from the switching amplifier 20.

Time of flight is determined from the difference in time between when the charge voltage was applied to a drop by a particular segment and when the charged drop is detected downstream at the drop velocity sensor 32. Alternatively, in place of sensor 32, the last segment (the segment furthest from nozzle) of the charge tunnel may be used as a detector to detect the charge applied to a drop by previous segment(s). This arrangement eliminates the need for an independent charge detector. When the last segment is used for detection, it is used as a capacitive pickup and is not used to charge the stream. In either case, precise knowledge of the location of the drop break-off point, in combination with accurate measurements of flight time, allows for constant drop separation by precise adjustment of velocity. Inaccuracies in drop separation must be minimized because they lead to significant printing distortions since droplet deflection is related to the square of droplet velocity.

Figure 4:
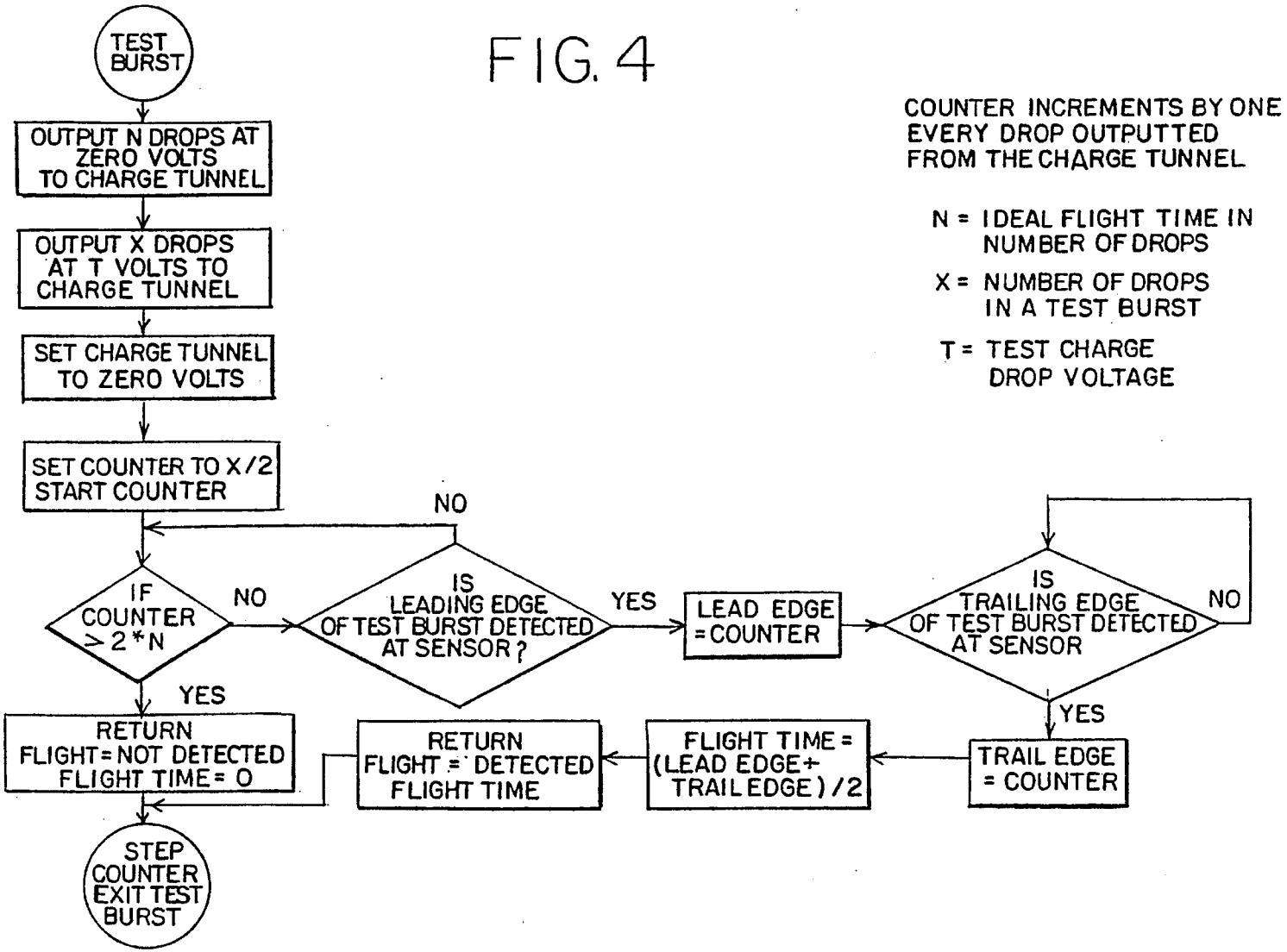
FIG. 4 is a flow diagram illustrating the manner in which a group of ink drops are charged and sensed.
Figure 5:
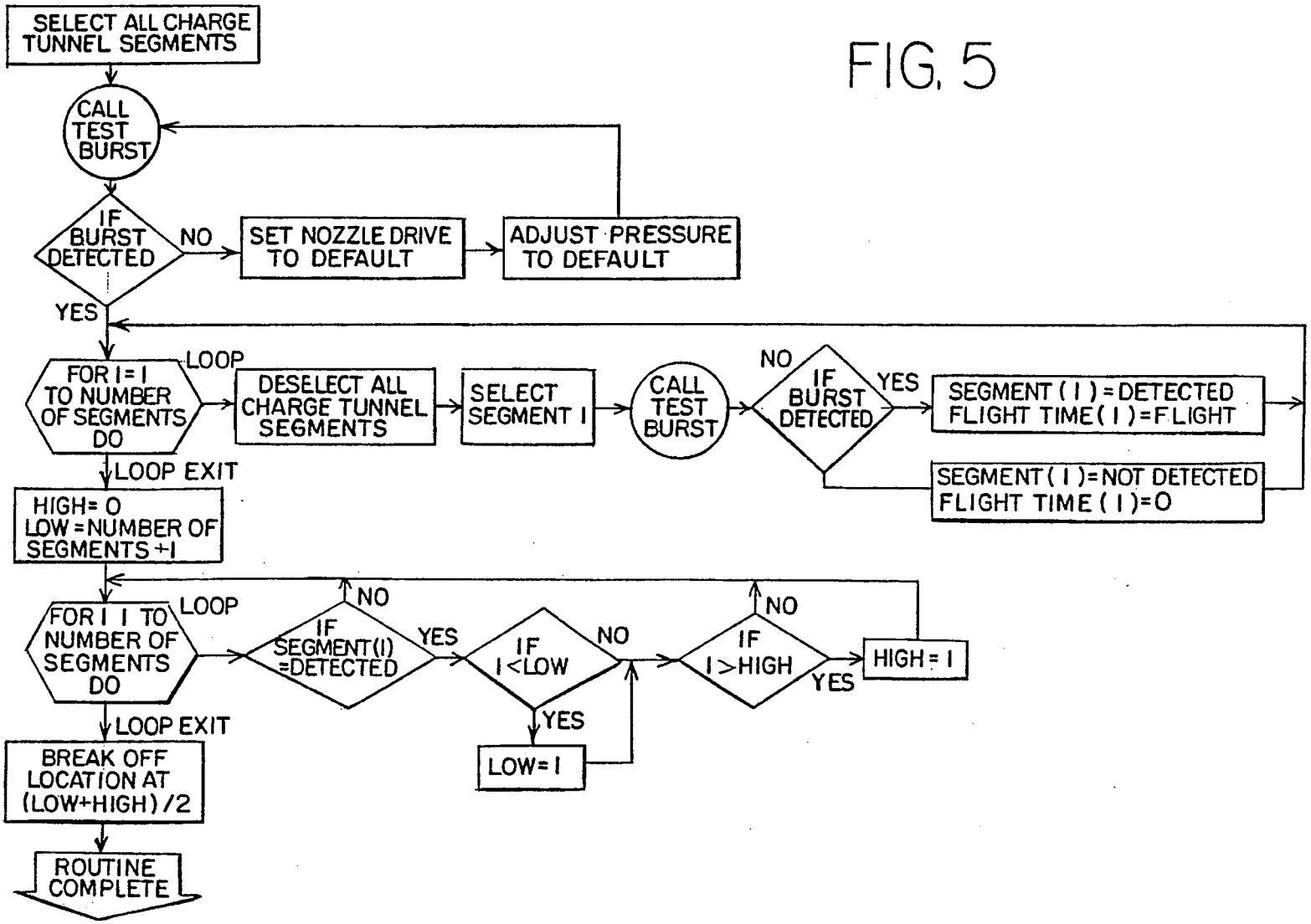
FIG. 5 is a flow diagram illustrating the manner in which the break-off point of the droplets is located in the charge tunnel using the segmented charge tunnel and the steps associated with charging and sensing a group of ink drops.

Referring to FIGS. 4 and 5, during setup and periodically thereafter, the segments 42*a*–42*e* of tunnel 18 are sequentially operated by the controller 34 through the switching amplifier 20 so that a charging voltage is applied to each designated segment in a predetermined sequence. The charges placed on the droplets are then detected downstream until a maximum charge is detected. The flight distance is calculated to an accuracy of one segment by the controller 20 since the specific charge segment associated with the maximum charge is known. Subsequently, the flight time is calculated by the controller 20 and is typically used to adjust various ink and operating conditions, such as ink pressure, stored in data file memory 38. Through the use of feedback to the ink control system, the controller 20 can correct for slow or fast flight times. For example, solvent can be added to compensate for evaporation; pressure or temperature can be adjusted, etc. In that regard, see U.S. Pat. No. 4,555,712 hereby incorporated by reference.

Additionally, the centrally located segments can be utilized to initially position the stream break-off point in the middle of the segmented charge tunnel 18. This is accomplished by the controller 20 activating only the centrally located segments while varying the nozzle drive voltage magnitude, usually from a low level to a high level, which causes the break-off point to move within tunnel 18. Since only a midpoint segment is utilized, once a maximum charge is detected, the break-off point of the ink jet stream is located near the middle of the segmented charge tunnel 18. This adjustment technique can be used periodically to insure that the break-off point remains positioned as desired.

Charge variations on the droplets can be purposefully accomplished through the utilization of the invention as well as variations in deflection. These types of variations are brought about by selecting one or more charge segments 42 which are both close to and removed from the break-off point of the ink stream. Instead of varying the voltage which is applied to the individual charging segment 42, the charge on each drop can be changed by varying the individual segments 42 used to charge it. For example, one set of voltage variations could be used so that twin line printing may be accomplished.

Figure 3:
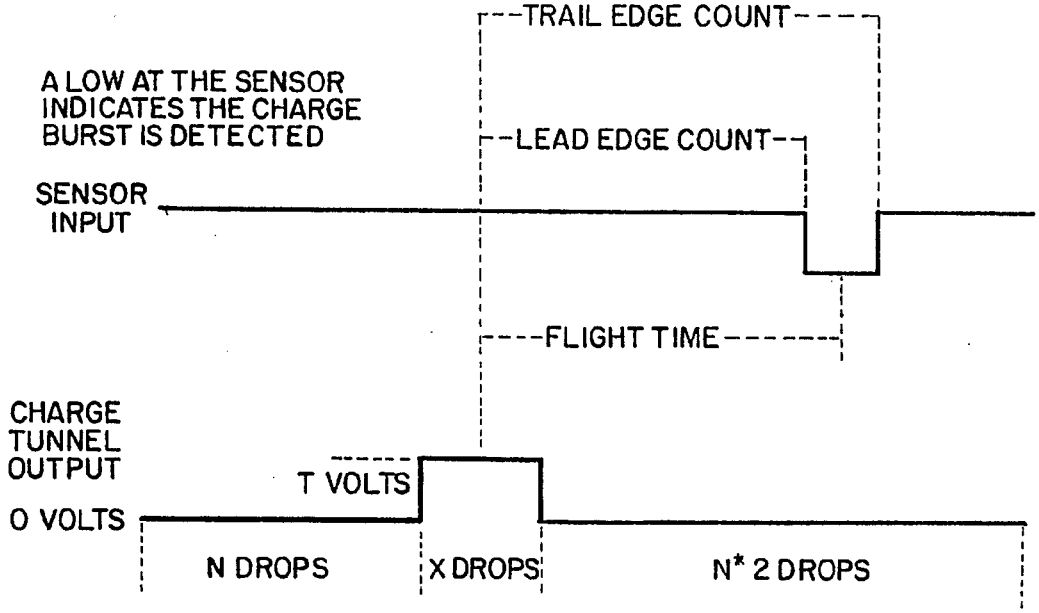
FIG. 3 is a timing diagram useful in explaining the time relation between the charging of the ink drops and the sensing of the charge on the drops.

Referring to FIG. 4, a routine which may be used to output and sense a test burst of drops is illustrated. This routine is used periodically to determine flight time to check on ink composition. The first steps are for the controller 20 to output N ink drops at 0 volts followed by X ink drops charged by a selected segment to a test voltage T. The segments 42 are then set to a level of 0 volts. A counter is set to the value of one-half of X (the number of drops in the test burst) and is sequentially incremented. FIG. 3 illustrates the relationship between the time when the drops are charged and the time when the charge on the drops is sensed by sensor 32.

If the counter reaches a value greater than 2N, then the routine is aborted and the system returns to default value indicating the test burst was not detected by the sensor 32. Otherwise, the counter is incremented until the leading edge of the test burst is detected by sensor 32, the value of the counter being stored. The counter continues to be incremented until the trailing edge of the test burst is detected, the value of the counter at that time also being stored. Flight time is then calculated by averaging the stored values of the counter representing the leading and trailing edges of the test burst. Flight time may then be used to alter ink composition or pressure as described in the referenced U.S. Patent.

FIG. 5 illustrates a routine used to locate the position of the break-off point within the segmented charge tunnel 18. If an initial test burst is not detected when all of the segments 42 of segmented charge tunnel 18 are selected, then the nozzle drive level of driver 16 and the pressure of ink system 10 is set to default and the routine starts again.

When a burst, or portion thereof is detected, a first loop is presented wherein data is stored in an array which has a number of cells equal to the number of segments 42 of charge tunnel 18 (5 in the illustrated example). Each segment is selected in turn and a test burst generated. If a burst is detected when a certain segment is selected, then the flight time as determined by the steps illustrated in the flow diagram of FIG. 4 is stored in the corresponding cell of the data array. If a burst is not detected, then a value of 0 is stored in the associated cell of the data array.

A second loop is then executed wherein the location of the break-off point within the charge tunnel is determined by averaging values in the array. The first value is set by the position of the detected flight time data in the data array and the second value is set to the same value as long as the loop iteration counter I is greater than that value before it is set.

In the alternative case where the last segment is used in place of sensor 32, the controller operation illustrated in FIG. 5 is modified slightly. In each case where the number of segments is used as an index, the count is reduced by one to exclude the last segment, which is functioning as the sensor. Thus, for example, in Loop 1, the logic statement "For I=1 to Number of Segments" would change to "For I=1 to Number Segments— 1".

An important advantage of the segmented charge tunnel according to the invention, is the ability to print descenders and twin lines more efficiently than is possible in the prior art. Currently a table of voltages for each drop of a character stroke is generated for normal characters (no descender). A second table of voltages for each drop of a character stroke is generated for descender characters. The generation of these tables takes twice as long as the generation of a single table. Additionally, the tables require twice the storage area. Printing descenders with the segmented charge tunnel of the invention is possible without these drawbacks.

To do so, first the optimum segment(s) (for drop maximum charge) is determined (see FIG. 5). This segment(s), closest to the break-off point, is used to print the non-descender characters. Conversely, segment(s) further away from drop break-off are used to print descender characters. The same voltage table is used to print descender characters as the normal characters. The descender character(s) are shifted lower on the print surface because the electric field strength charging the drop is weaker. In this fashion, a single table of voltages can be used to print both normal and descender characters, thus decreasing the storage area for the table and decreasing the time required to develop the table.

Twin line printing (printing two lines at a time) can be similarly accomplished. Currently, separate tables of voltages are required for printing the top and bottom lines in a twin line operation. According to the invention, segment(s) placing maximum charge on a drop can be used for printing the top line. Segment(s) further from the drop break-off can be used for printing the bottom line. The same table of voltages would be used for simultaneously printing both the top and bottom lines.

Figure 6:
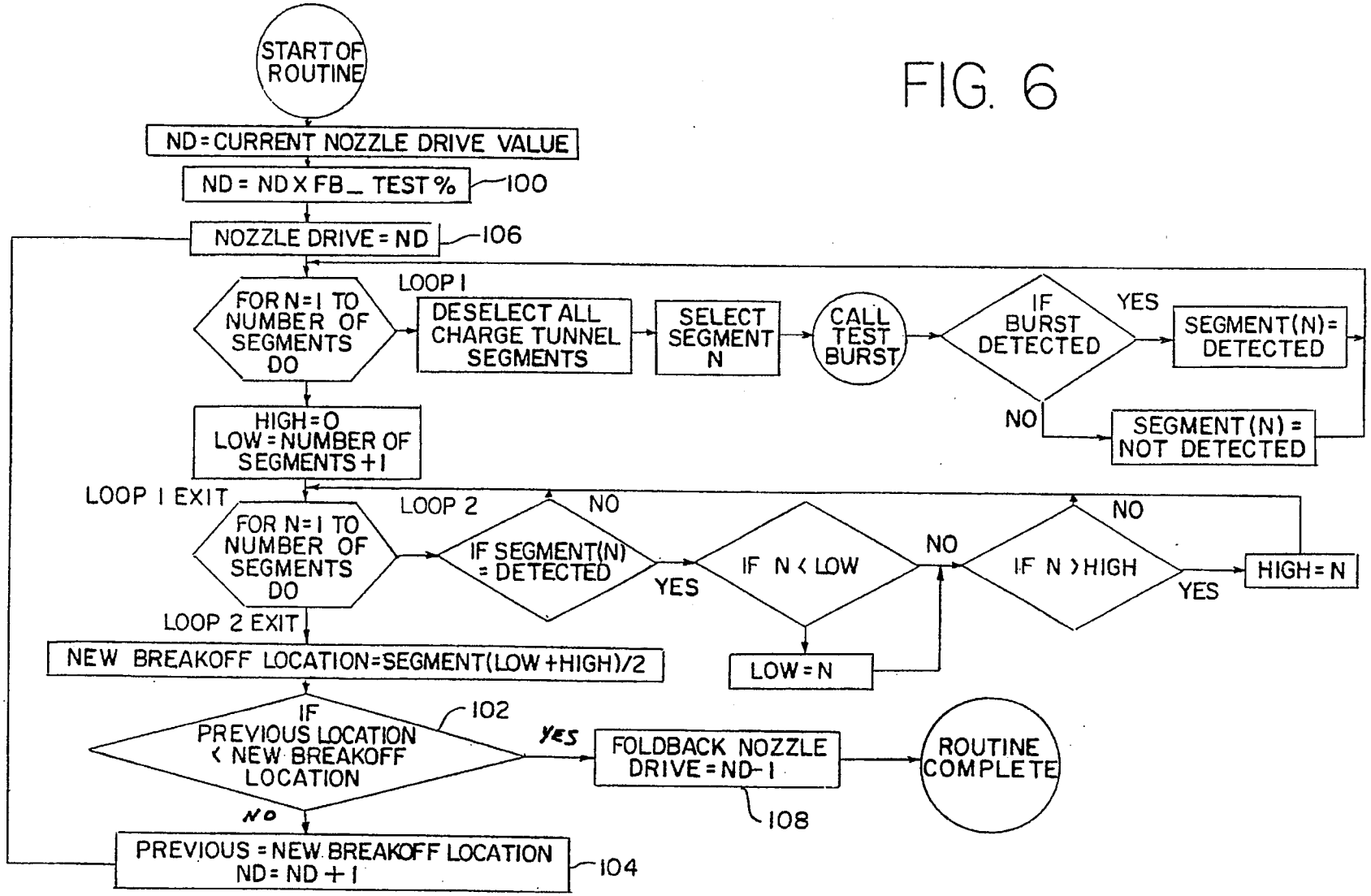
FIG. 6 is a flow diagram similar to FIG. 5 illustrating the manner in which the foldback point may be determined.

Referring to FIG. 6 there is disclosed a block diagram of a software routine for use with the present invention to determine the foldback point. As mentioned previously, the foldback point is a term of art which defines the ink break-off point which is closest to the nozzle. It is referred to as the foldback point because as nozzle drive voltage is slowly increased, the break-off point will move progressively closer to the nozzle until the minimum value is reached. Thereafter, further increases in nozzle drive cause the break-off point to reverse and move further away from the nozzle. For a detailed discussion of foldback as it pertains to ink jet systems, see U.S. Pat. No. 5,196,860 hereby incorporated by reference.

The foldback point is useful because the good printing region for many inks can be determined by reference to this value. Thus, for example, a good printing region may be a known voltage offset from the nozzle drive voltage value at the foldback point. Accordingly, it is desired, during set-up of a printer system, to determine foldback and then adjust the system operating parameters accordingly. The segmented charge electrode of the present invention, in addition to determining flight time and the actual location of the break-off, can determine the foldback point. As shown in FIG. 6, the nozzle drive voltage is first reduced to a small percentage of its preset or default value to begin the test (Step 100). Thereafter the routine increments the nozzle drive during each iteration until the foldback is detected.

Loop 1 determines which charge segments are detected for a given nozzle drive voltage as explained in more detail in connection with FIG. 5. In particular, Loop 1 determines which segments successfully charge a test burst for a given nozzle drive voltage. Loop 2, as described in connection with FIG. 5, determines an average of the detected segments, which average is the break-off position within the charge tunnel.

At Step 102 a comparison is performed between the present break-off location (segment) and the previous segment. If the present segment is less than the previous segment, the nozzle drive value is incremented, Step 104, and the routine loops back to 106. If, however, the new segment is greater than the previous segment, then foldback has been detected and the associated nozzle drive was the last (previous) nozzle drive value, Step 108. Of course, the technique could be used in reverse, that is, starting with a maximum voltage value and decreasing it until reversal is detected. The routine then terminates and the foldback information is used by the system controller to ensure that initial set-up optimizes print quality. This ensures that the break-off point is within the charge tunnel and also that the break-off point is within the "good printing" region based on empirical data for the particular ink being used. Such data, as explained in the referenced '860 patent, relates the foldback point to the particular ink characteristics to determine optimum nozzle drive values.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for determining the flight time of a stream of ink drops in an ink jet printing system utilizing a segmented charge tunnel with a plurality of individual segments, each of which can be selectively used to charge drops, and a charge sensor downstream from said tunnel, the method comprising the steps of:

(a) causing a jet of ink to separate into a stream of ink drops at a break-off point within said segmented charge tunnel;

(b) determining which of said segments is closest to said break-off point and employing the segment closest to said break-off point to charge said ink drops;

(c) detecting said charged ink drops with said charge sensor; and (d) determining the time of flight of the ink drop stream by measuring the time period from when said drops are charged to when said drops are detected by said charge sensor.

2. The method of claim 1 wherein the step of determining which segment is closest includes the substeps of:

providing a plurality of test bursts of ink to said segmented charge tunnel, the number of test bursts being equal to the number of segments used to charge drops;

sequentially operating said segments, one at a time, such that each time a test burst is provided, a different one of said segments is used to charge drops in said test burst;

detecting the charge on the drops in said test bursts with said charge sensor; and identifying which of said charge tunnel segments is associated with a maximum charge.

3. The method of claim 1 wherein the steps of determining flight time includes the substeps of:

starting a counter during drop charging;

stopping said counter when the charge drops are detected by said charge sensor.

4. An apparatus for determining the foldback point for a stream of electrically conductive ink emitted from a nozzle in an ink jet printing system comprising:

(a) means for applying a series of drive voltages to said nozzle to cause the stream to break into drops, said voltages increasing in magnitude from a minimum value or decreasing in magnitude from a maximum value;

(b) a segmented charge tunnel having a plurality of individual segments disposed in operative proximity to said stream, each of said segments capable of inducing an electric charge on said drops;

(c) means for operating said segments, one at a time, to charge drops breaking off from said stream;

(d) means for sensing which of said segments produces a maximum charge on said drops indicative of being closest to the drop break-off point; and (e) means for determining the foldback point by detecting direction reversal between successive segment(s) determined to be closest to the break-off point.

5. An ink jet printing system for producing images on an object comprising:

(a) a nozzle having an orifice for forming a jet of ink;

(b) means for supplying electrically conductive ink to said nozzle;

(c) means for causing said ink jet to break into discrete drops at a break-off point downstream from said nozzle;

(d) a segmented charge tunnel having a plurality of individually controllable segments placed in operative proximity to the flight path of said jet for inducing an electric charge thereon as said drops break away from said ink jet;

(e) means for determining the segment closest to the break-off point and for selecting said segment closest to the break-off point to charge said drops; and (f) high voltage deflection plates placed in operative proximity to the flight path of said charged drops to deflect them onto said printing medium.

6. The ink jet printing system of claim 5 wherein said determining means includes:

(a) means for providing a plurality of test bursts of ink, the number of test bursts being equal to the number of segments of said segmented charge tunnel used for charging drops;

(b) means for operating a different one of said segments, each time a test burst is produced;

(c) a drop charge sensor located downstream of said segmented charge tunnel for identifying which segment is associated with a maximum charge to said drops.

7. The apparatus of claim 6 further comprising means for determining the time of flight of said charged drops by measuring the difference in time between when electrical charges are applied by the segment associated with maximum drop charge and when the charged drops are detected by said drop charge sensor.

8. An apparatus for locating the drop break-off point of a stream of electrically conductive ink in an ink jet printing system comprising:

(a) a segmented charge tunnel having a plurality of individual segments disposed in operative proximity to the break-off point of said stream, each of said segments capable of inducing an electric charge on said drops;

(b) means for sequentially operating said segments, one at a time to charge drops breaking off from said stream; and (c) means for sensing which of said segments produces a maximum charge on said drops indicative of being closest to the drop break-off point.

9. The apparatus of claim 8 further comprising means for determining the time of flight of said charged drops by measuring the difference in time between when electrical charges are applied by the segment associated with the maximum drop charge and when the charged drops are detected by said sensing means.

10. An ink jet printing system for simultaneously printing twin lines of images on an object comprising:

(a) a nozzle having an orifice for forming a jet of ink;

(b) means for supplying electrically conductive ink to said nozzle;

(c) means for causing said ink jet to break into discrete drops at a break-off point downstream from said nozzle;

(d) a segmented charge tunnel having a plurality of individually controllable segments placed in operative proximity to the flight path of said jet for inducing an electric charge thereon as said drops break away from said ink jet;

(e) means for selecting the charge tunnel segment closest to the break-off point to charge drops intended for a first line of images and a different charge tunnel segment, further from the break-off point for a second line of images; and (f) high voltage deflection plates placed in operative proximity to the flight path of said charged drops to deflect them onto said printing medium, as a function of the magnitude of the charges induced by said segments, thereby to simultaneously print two lines of images.

11. A method for determining the flight time of a stream of ink drops in an ink jet printing system utilizing a segmented charge tunnel with a plurality of individual segments, each of which can be selectively used to charge drops, or to detect charged drops, the method comprising the steps of:

(a) causing a jet of ink to separate into a stream of ink drops at a break-off point within said segmented charge tunnel;

(b) determining which of said segments is closest to said break-off point and charging said ink drops using said closest segment;

(c) detecting said charged ink drops with the most downstream segment of said charge tunnel;

(d) determining the time of flight of the ink drop stream by measuring the time elapsed from when said drops were charged to when said drops are detected by said most downstream segment.

12. An apparatus for locating the drop break-off point of a stream of electrically conductive ink in an ink jet printing system comprising:

(a) a segmented charge tunnel having a plurality of individual segments disposed in operative proximity to the break-off point of said stream, each of said segments capable of inducing an electric charge on said drops;

(b) means for sequentially operating each of said segments, except the most downstream segment, one at a time, to charge drops breaking off from said stream; and (c) means for sensing which of said segments produces a maximum charge on said drops indicative of being closest to the drop break-off point, said means for sensing comprising the most downstream segment which is operated as a capacitive detector.

13. The apparatus of claim 12 further comprising means for determining the time of flight of said charged drops by measuring the difference in time between when electrical charges are induced on the drops by the segment closest to the break-off point and when the charged drops are detected by said most downstream segment.

14. A method for determining the foldback point for an ink stream emitted from a nozzle in an ink jet printing system utilizing a segmented charge tunnel with a plurality of individual segments, each of which can be selectively used to charge drops, the method comprising the steps of:

(a) applying a series of drive voltages to said nozzle to cause said ink stream to separate into drops at break-off points within said segmented charge tunnel; said voltages increasing in magnitude from a minimum value or decreasing in magnitude from a maximum value;

(b) determining the segment(s) closest to said break-off point for each voltage value;

(c) determining the foldback point by detecting direction reversal between successive segment(s) determined to be closest to the break-off point.

15. The method of claim 14 wherein step (b) includes the substeps of:

attempting to charge drops with each segment in the charge tunnel;

detecting which segment(s) successfully charge drops; and storing the identity of the segments which successfully charge drops.

16. The method of claim 15 wherein the substep of detecting includes employing a charge sensor downstream of said charge tunnel.

* * * * *